US007004062B2

(12) United States Patent
Paduano

(10) Patent No.: US 7,004,062 B2
(45) Date of Patent: Feb. 28, 2006

(54) ELEVATOR PIT RECEPTACLE WITH FLOAT VALVE ASSEMBLY

(76) Inventor: Charles Paduano, 10402 SW. 50th Ct., Cooper City, FL (US) 33328

( * ) Notice: Subject to any disclaimer, the term of this patent is extended or adjusted under 35 U.S.C. 154(b) by 0 days.

(21) Appl. No.: 10/829,708

(22) Filed: Apr. 23, 2004

(65) Prior Publication Data

US 2005/0235822 A1 Oct. 27, 2005

(51) Int. Cl.
*F01B 31/00* (2006.01)

(52) U.S. Cl. ..... 92/86; 60/455

(58) Field of Classification Search ..... 92/86; 60/455

See application file for complete search history.

(56) References Cited

U.S. PATENT DOCUMENTS 3,001,367 A * 9/1961 Bartholomew ..... 60/467
3,183,669 A * 5/1965 McGuire ..... 92/86
3,741,075 A * 6/1973 Moseley et al. ..... 92/86
4,017,214 A * 4/1977 Smith ..... 92/86
4,463,663 A * 8/1984 Hanson et al. ..... 92/86

* cited by examiner

*Primary Examiner*—Thomas E. Lazo

(57) ABSTRACT

An elevator pit receptacle and float valve assembly provide for the safe displacement and collection of seeped hydraulic fluid from an elevator cylinder/piston assembly. The receptacle is elevated above the ground yet is below the cylinder seepage ring. A float valve is connected to the ring's drainage hole at one end, and a tube is connected therefrom to the receptacle. Should hydraulic fluid leak into the seepage ring, and the level of such fluid rises above the drainage hole, the fluid drains, by gravity, into the pit receptacle. In the event water intrudes into the elevator pit to a level that reaches the float, as the float rises, the valve shuts closed which prevents an unwanted commingling of water and drained fluid.

17 Claims, 5 Drawing Sheets

ELEVATOR PIT RECEPTACLE WITH FLOAT VALVE ASSEMBLY

BACKGROUND OF THE INVENTION

1. Field of the Invention

The present invention relates to a method and apparatus for retaining overflow spillage of hydraulic oil into a receptacle container. More specifically, the present invention provides for a float valve assembly along with a receptacle for containing overflow spillage of hydraulic fluid from an elevator hydraulic cylinder.

2. Description of the Prior Art

It is commonplace to utilize hydraulic cylinders for passenger or cargo raising and lowering within an elevator environment. The elevator car is raised and lowered by the below located hydraulic piston and cylinder assembly which is typically located below grade, or ground level, in an elevator pit. It is not uncommon with this type of elevator system for the hydraulic cylinder to have a seal to retain the hydraulic fluid within it when the piston is raised and lowered. When the seal becomes faulty and leaks, unwanted amounts of hydraulic fluid escape the system. The escaped fluid is a potential environmental hazardous if it flows into the environment.

Currently, and in the past, the escaped hydraulic fluid is retained within a channeled annular ring just below the seal to catch the escaped fluid. The annular ring has a drainage hole to displace the collected, escaped fluid so that it does not flow over the ring. The drainage hole is connected to a tubing or other conduit whose free end is typically placed in a large bucket to collect the fluid which is gravity fed into the bucket. The bucket is simply placed on the ground of the elevator pit. Service technicians attend to the bucket from time to time to dispose of the displaced fluid in an environmentally appropriate manner. However, this system of collecting displaced hydraulic fluid in an elevator pit has a number of drawbacks.

Generally speaking, the collection bucket is not secured to anything; thus, it can easily be kicked or spilled during servicing. Also, water can enter the below-ground elevator pit through groundwater intrusion, leaky roofs, broken water pipes in the building, rain water, etc. When this occurs, the water, being heavier than the collected hydraulic fluid, can cause the collection bucket to lift and spill over causing an unacceptable environmental hazard with the mixing of spilled fluid and water. The spill requires cleanup and additional maintenance of the pit area which is expensive. Further, some elevator assemblies include an automatic sump pump within the pit area to dispose of potential water intrusion. However, should there be a commingling of fluid and water, the mixture would unintentionally be automatically pumped either directly to the surrounding ground area or to the local municipal water treatment facility.

SUMMARY OF THE INVENTION

An elevator pit receptacle and float valve assembly provide for the safe displacement and collection of seeped hydraulic fluid from an elevator cylinder/piston assembly. The receptacle is elevated above the ground yet is below the cylinder seepage ring. A float valve is connected to the ring's drainage hole at one end, and a tube is connected therefrom to the receptacle. Should hydraulic fluid leak into the seepage ring, and the level of such fluid rises above the drainage hole, the fluid drains, by gravity, into the pit receptacle. In the event water intrudes into the elevator pit to a level that reaches the float, as the float rises, the valve shuts closed which prevents an unwanted commingling of water and drained fluid.

It is thus an object of the present invention to provide for an elevator pit receptacle and float valve assembly.

It is still another object of the present invention to provide an elevator pit receptacle that is elevated from the floor.

It is still yet another object of the present invention to provide an elevator pit receptacle that can prevent the unwanted commingling of intruded water in the pit with discharged hydraulic fluid from the elevator cylinder/piston assembly.

It is still another object of the present invention to utilize a float valve with an elevator hydraulic fluid receptacle to provide an automatic close-off of the receptacle in the event of flooding of the elevator pit area, to prevent commingling of water and hydraulic fluid.

It is another object of the present invention to provide for a waterproof, and a spill proof, hydraulic fluid containment system.

These and other advantages and features of the present invention will become more apparent when the drawings as well as the detailed description are read together.

BRIEF DESCRIPTION OF THE DRAWINGS

For a more complete understanding of the nature of the present invention, reference should be made to the following detailed description taken in connection with the accompanying drawings, in which.

DETAILED DESCRIPTION OF A PREFERRED EMBODIMENT

Figure 1:
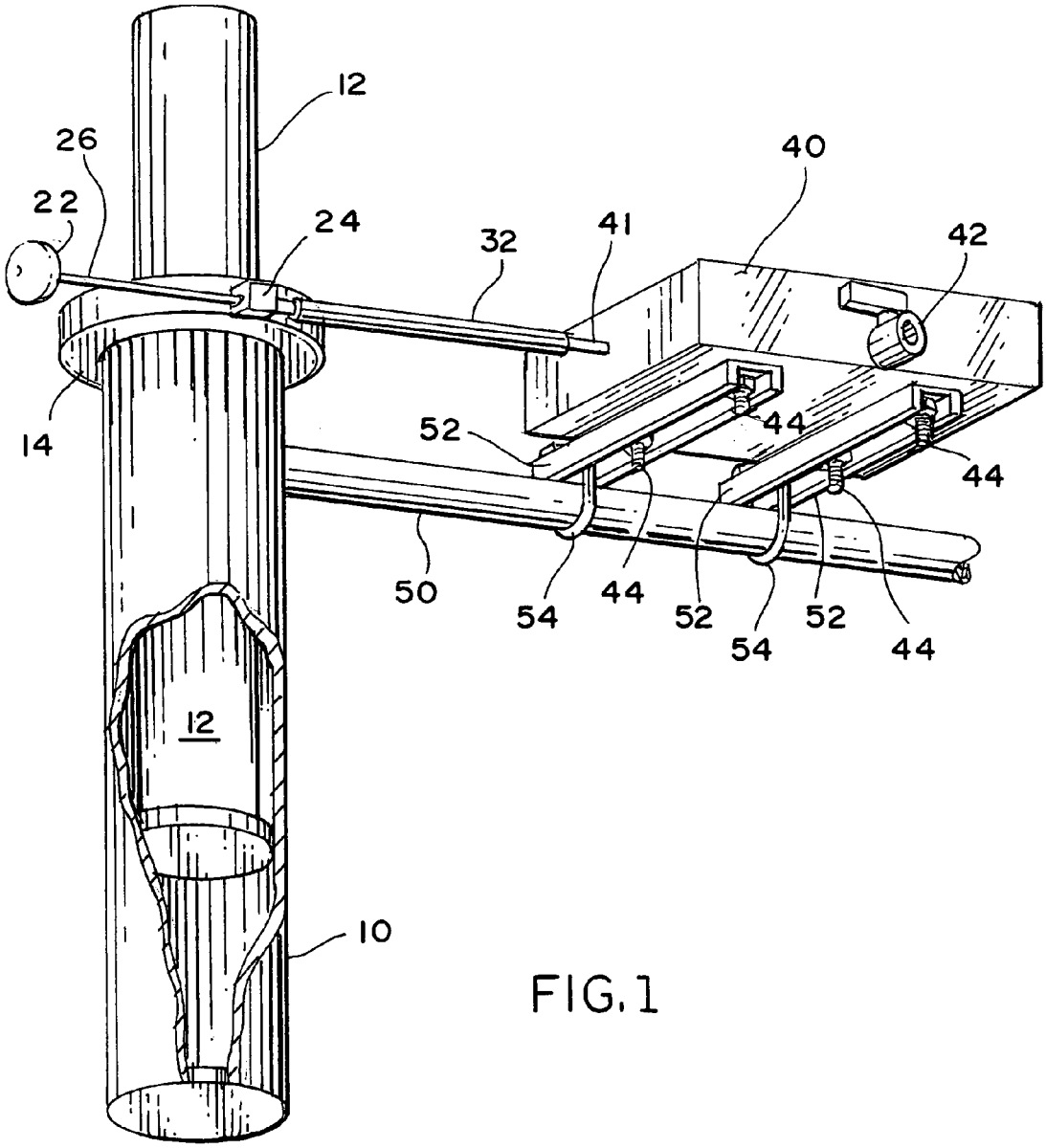
FIG. 1 is a bottom perspective view of the present invention.
Figure 2:
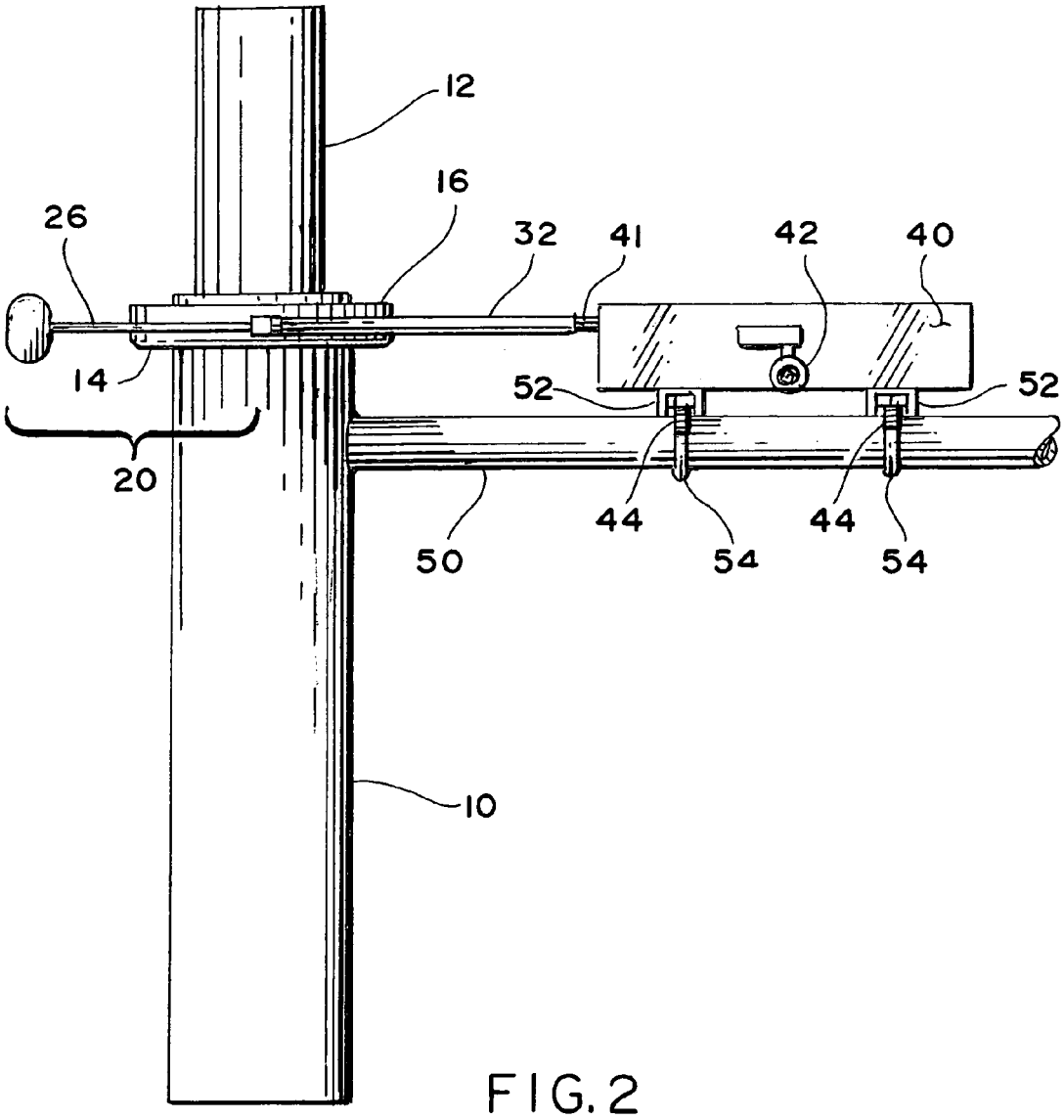
FIG. 2 is a front view of the present invention.
Figure 3:
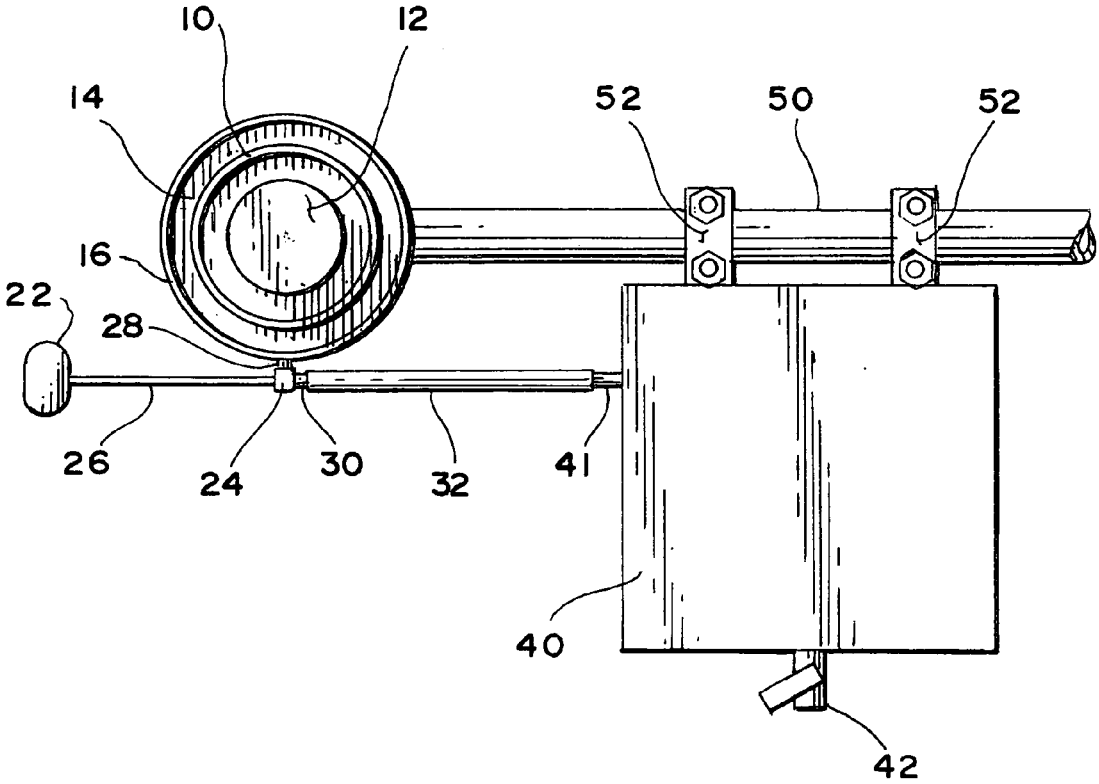
FIG. 3 is a top plan view of the present invention.
Figure 4:
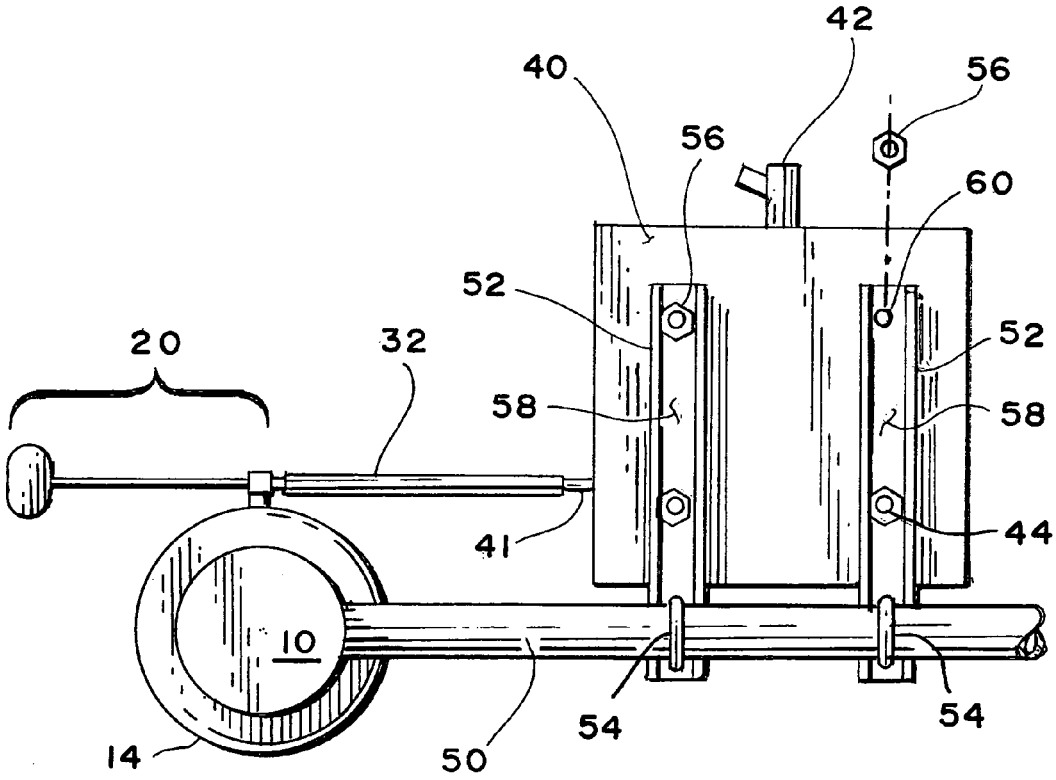
FIG. 4 is a bottom plan view of the present invention.
Figure 5:
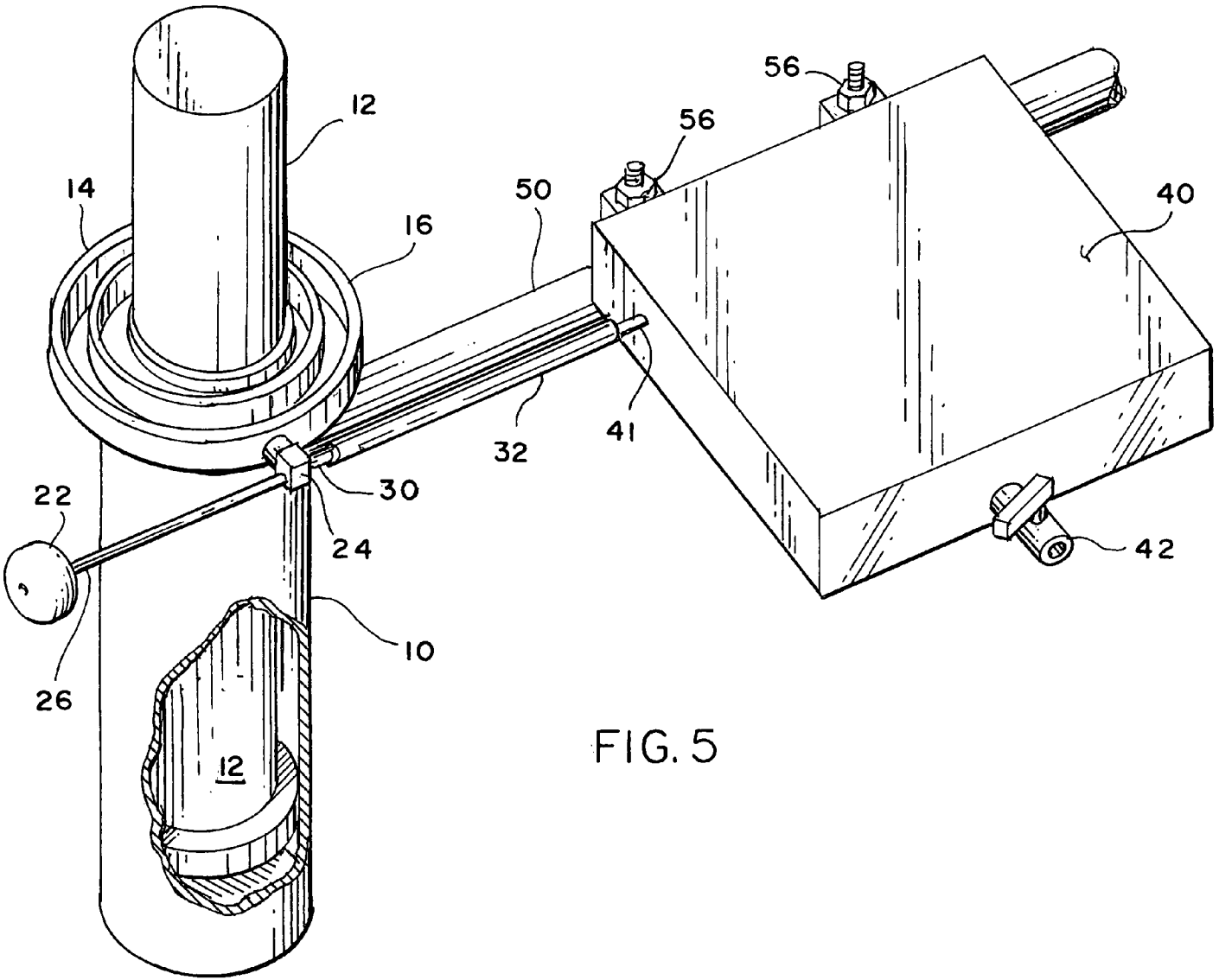
FIG. 5 is a top perspective view of the present invention.

As shown in the accompanying figures, the present invention is directed to an elevator pit receptacle with a float valve assembly. The elevator pit (not shown) generally comprises an elevator mechanism. The elevator mechanism further comprises an hydraulic cylinder 10 and an hydraulic piston 12 emanating therefrom. Along the cylinder 10 is an annular, channeled drainage or seepage ring 14. The ring 14 has an outer edge 16 through which a drainage hole is bored.

Connected to the drainage hole of ring 14 is a float valve assembly 20. The float valve assembly 20 comprises a float ball 22, a float valve 24, and a float rod 26 connecting the float ball 22 to the float valve 24. The float valve 24 is secured to the drainage hole which may be threaded, either male or female, of the ring 14 whereby the float valve 24 may have a matable, female or male, thread to be fitted into the threaded hole. In the alternative, the float valve 24 may be secured to the hole by suitable means, such as welding if the ring 14 and the valve 24 are made of a metal material, or by an appropriate adhesive.

The float valve 24, in the preferred embodiment, has a general elbow or "L" shaped configuration; one end 28 is secured to the ring 14, while the other end 30 is connected to a receptacle by tubing 32. The tubing is manufactured of a rubber, or plastic synthetic material, and may be made of a metal such as copper, or such other acceptable material suitable for the purpose of transferring seeped hydraulic fluid from the ring 14 to the receptacle 40. The tubing 32 is secured at a port 41 of the receptacle 40 by frictional engagement or other suitable mechanical means such as clamps (not shown). Where the receptacle 40 is made of plastic, the port 41 may be molded into it.

The receptacle 40 is comprised of a sealed container. The receptacle 40 may be made of any suitable material, but preferably is manufactured from plastic. More specifically, it is preferred that the plastic receptacle 40 be clear or translucent so that fluid build-up is visually perceptible. The receptacle has a point of fluid egress so that it can be serviced. In the preferred embodiment, the figures depict a self closing, spring activated discharge valve 42 egress point. The self closing discharge valve's resting position is closed. The purpose of having a self closing discharge valve 42 is obvious; prevention of unwanted discharge. However, a manually activated discharge valve 42 having an open position and closed position can also be used, though care must be used to secure the valve in the closed position after servicing.

In the preferred embodiment, the receptacle 40 is configured in a rectangular box, having a capacity of at least five (5) gallons. The figures show the receptacle 40 is mounted off the ground. While the preferred embodiment teaches a receptacle affixed to the hydraulic fluid feed pipe 50 to lift and secure the receptacle 40 off of the ground, the receptacle 40, may, alternatively, be mounted to the interior wall of the elevator pit (not shown). However mounted, the receptacle must be disposed below the level of the drain hole located in the ring 14 so that seeped fluid located within the ring moves, by gravity, through the tubing 32 and into the receptacle 40.

The preferred embodiment depicts a mounting of the receptacle 40 onto the feed pipe 50 by bracket means. The bracket means disclosed comprises at least one channeled strut 52 (two such struts 52 are shown). The struts 52 are secured to the hydraulic feed pipe 50 by pipe clamps 54 which are capped off by nuts 56. The struts 52 are substantially "C" shaped, and have a web 58. The web 58 has apertures 60 for accepting matable studs 44 of the receptacle 40. If the receptacle 40 is made of plastic, the studs 44 can be molded onto the underside of the receptacle 40. If the receptacle 40 is made of metal, the studs 44 can be welded onto the receptacle. The studs 44 provide for a securely mounted receptacle 40.

In operation, where hydraulic fluid seeps into the drainage ring 14 and rises to the level of the drainage hole, the fluid escapes the ring 14 and runs through the tube 32, by gravity, into the receptacle 40. When the receptacle 40 fills with fluid and is to be serviced by a technician, the technician can enter the elevator pit, open the discharge valve 42 and allow the drained fluid to be emptied into a separate container for proper disposal. In the event of entry of water by ground intrusion or other flooding means, where the flood water rises to the level of the float ball 22, the ball 22 rises moving the float rod 26 to shut off the float valve 24 in a closed position. In this manner, the drained hydraulic fluid located in the receptacle 40 is segregated from the flood water thereby preventing an unwanted mixing of the two liquids. The receptacle 40, being secured to the feed pipe 50, or other appropriate mountable base, is thus spill proof.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An elevator pit receptacle drainage assembly, said assembly comprising a receptacle, means for connecting said receptacle to a drain member, and float valve assembly shut off means connected to said drain member.

2. In the drainage assembly of claim 1, said means for connecting said receptacle to said channeled drain member comprising a tube.

3. In the drainage assembly of claim 2, said receptacle comprising a port for engagement with said tube.

4. In the drainage assembly of claim 1, said float valve assembly further comprising a float ball, a float rod, and a float valve, whereby said rod connects said ball to said valve.

5. In the drainage assembly of claim 1, said assembly further comprising means for securing said receptacle off of the floor of said elevator pit.

6. In the drainage assembly of claim 5, said securing means further comprising two clamps, two struts each having at least one aperture, wherein said receptacle provides for at least one protruding stud member that is matably engageable with said aperture.

7. In the drainage assembly of claim 1, said assembly further comprising a hydraulic fluid feed pipe, where said securing means comprises at least one clamp being affixed about said pipe and to said receptacle.

8. In the drainage assembly of claim 1, said receptacle comprising a discharge valve.

9. In the drainage assembly of claim 8, wherein said discharge valve is self-closing.

10. In the drainage assembly of claim 1, wherein said channeled drain member has a drain hole.

11. In the drainage assembly of claim 10, wherein said connecting means is secured to said drain hole.

12. An elevator pit receptacle drainage assembly, said assembly comprising a receptacle, tube means for connecting said receptacle to a drain hole located on the outer edge of a channeled drain member, and a float valve shut off means connected to said hole of said drain member, wherein said receptacle is secured off of the floor of said pit and lower than said drain hole.

13. In the drainage assembly of claim 12, said receptacle further comprises a port for connecting said tube means to said drain hole, and having a discharge valve.

14. In the drainage assembly of claim 13, wherein said discharge valve is self-closing.

15. An elevator pit receptacle drainage assembly, said assembly comprising a receptacle, a tube for connecting said receptacle to a drain hole located on an elevator hydraulic cylinder, wherein said receptacle is secured off of the floor of said pit and lower than said drain hole, and float valve assembly shut off means connected to said tube.

16. A method of draining, collecting and preventing seeped hydraulic fluid from mixing with intruded water in an elevator pit comprising an elevator assembly having an hydraulic cylinder and piston, said method comprising attaching a channeled drain member having a drainage hole to said assembly, affixing a collection receptacle securely off of the ground of said pit, whereby said receptacle is lower than said drainage hole for gravity feeding of seeped hydraulic fluid from said drainage member to said receptacle, connecting said drainage member to a float valve, and connecting a tube to one end of said float valve to the other end to said receptacle, collecting seeped hydraulic fluid from said drain member through said tube and into the said receptacle, and preventing said intruded water from mixing with said collected hydraulic fluid by means of said float valve wherein said float valve closes upon engagement of the said intruded water with said float valve.

17. In the method of claim 16, draining said receptacle through a discharge valve.

* * * * *